US007505019B2

(12) United States Patent
Hirama

(10) Patent No.: US 7,505,019 B2
(45) Date of Patent: Mar. 17, 2009

(54) DRIVE CIRCUIT

(75) Inventor: Atsushi Hirama, Tokyo (JP)

(73) Assignee: Oki Semiconductor Co., Ltd. (JP)

( * ) Notice: Subject to any disclaimer, the term of this patent is extended or adjusted under 35 U.S.C. 154(b) by 647 days.

(21) Appl. No.: 10/863,512

(22) Filed: Jun. 9, 2004

(65) Prior Publication Data

US 2005/0017935 A1 Jan. 27, 2005

(30) Foreign Application Priority Data

Jun. 10, 2003 (JP) ..... 2003-164786

(51) Int. Cl.
*G09G 3/36* (2006.01)

(52) U.S. Cl. ..... 345/98; 345/87; 345/100; 345/204

(58) Field of Classification Search ..... 345/87–100, 345/204

See application file for complete search history.

(56) References Cited

U.S. PATENT DOCUMENTS 5,563,624 A * 10/1996 Imamura ..... 345/100
6,046,719 A * 4/2000 Dingwall ..... 345/100
6,204,836 B1 * 3/2001 Yamazaki et al. ..... 345/98
6,407,732 B1 * 6/2002 Stiens et al. ..... 345/204
6,456,281 B1 * 9/2002 Rindal ..... 345/204
6,529,181 B2 * 3/2003 Nakano et al. ..... 345/98
6,642,916 B1 11/2003 Kodama et al.
6,795,046 B2 * 9/2004 Janssen et al. ..... 345/87
7,116,297 B2 * 10/2006 Koga et al. ..... 345/87
2003/0034941 A1 * 2/2003 Janssen et al. ..... 345/87
2003/0112211 A1 * 6/2003 Hector ..... 345/87
2003/0142050 A1 * 7/2003 Kim ..... 345/87

FOREIGN PATENT DOCUMENTS

JP 11-030975 2/1999

* cited by examiner

*Primary Examiner*—Richard Hjerpe
*Assistant Examiner*—Kimnhung Nguyen
(74) *Attorney, Agent, or Firm*—Studebaker & Brackett PC; Donald R. Studebaker

(57) ABSTRACT

A source drive circuit which drives a source line group (source lines) of a liquid crystal display, includes a source driver group (source drivers) which outputs drive signals, an analog switch group which connects the outputs of the source driver group to the source line group and disconnects the same from the source line group, an analog switch group which shortcuts the source line group to a common power supply and disconnects the same from the common power supply, and a switch control circuit which controls switch operations of both the analog switch groups. The switch control circuit turns ON the analog switch group after it has detected that all analog switches of the analog switch group have been turned OFF, and turns ON the analog switch group B after it has detected that all analog switches of the analog switch group have been turned OFF.

15 Claims, 15 Drawing Sheets

DRIVE CIRCUIT

BACKGROUND OF THE INVENTION

1. Field of the Invention

The present invention relates to a liquid crystal drive circuit (source drive circuit and gate drive circuit or the like) which drives a matrix line group (gate line group and source line group or the like) placed in a liquid crystal panel of a liquid crystal device (liquid crystal display).

This application is counterpart of Japanese patent application, Serial Number 164786/2003, filed Jun. 10, 2003, the subject matter of which is incorporated herein by reference.

2. Description of the Related Art

As a conventional liquid crystal drive circuit, there has been proposed one wherein high-speed liquid crystal driving is realized by a precharge operation which upon 1-dot inversion driving or plural-dot inversion driving, disconnects output terminals (matrix lines) of the liquid drive circuit from outputs of drivers thereof and short-circuits the same to a common power supply or other output terminals disconnected from their corresponding drivers in like manner (see, for example, Japanese Laid Open Patent Application JP-A-11-30975.

FIG. 14 is a configurational diagram of such a conventional liquid crystal display. The conventional liquid crystal display includes a liquid crystal panel 1, a gate drive circuit 2, a source drive circuit 3, a source line group (m source lines $S_1$ through $S_m$) and a gate line group (n gate lines $G_1$ through $G_n$).

FIG. 15 is a circuit configurational diagram showing the conventional source drive circuit 3. As shown in FIGS. 14 and 15, the conventional source drive circuit 3 includes a source driver group (m source drivers $SD_1$ through $SD_m$), an analog switch group A (m analog switches $A_1$ through $A_m$) an analog switch group B (m analog switches $B_1$ through $B_m$) and an inverter I.

In the conventional source drive circuit 3, the analog switch group A is turned OFF and the analog switch B is turned ON when an input signal PC is "0 and an output signal PCB of the inverter I is "1". Thus, output terminals $OUT_1$ through $OUT_m$ (source lines $S_1$ through $S_m$) of the source drive circuit 3 are connected to their corresponding outputs of the source drivers $SD_1$ through $SD_m$ so that signals outputted from the source drivers $SD_1$ through $SD_m$ are respectively outputted to the source lines $S_1$ through $S_m$.

Then, when the input signal PCB is brought to "1" and the output signal PCB of the inverter I reaches "0", the analog switch group A is turned ON and the analog switch group B is turned OFF so that the output terminals $OUT_1$ through $OUT_m$ (source lines $S_1$ through $S_m$) of the source drive circuit 3 are respectively disconnected from the outputs of the source drivers $SD_1$ through $SD_m$. Thus, the output terminals $OUT_1$ through $OUT_m$ thereof are short-circuited to a common power supply $V_{com}$ so that precharge is carried out.

When the input signal PC is returned to "0" and the output signal PCB of the inverter I is returned to "1", the analog switch group A is turned OFF and the analog switch group B is turned ON so that the output terminals $OUT_1$ through $OUT_m$ (source line $S_1$ through $S_m$) of the source drive circuit 3 are disconnected from the common power supply $V_{com}$ and connected to the outputs of the source drivers $SD_1$ through $SD_m$ again, respectively.

In the conventional liquid crystal drive circuit, however, the two analog switch groups are controlled by the same one input signal PC. Therefore, a delay is developed in switching timing between both analog switch groups due to the capacitance of each analog switch and wiring capacitance or the like. The analog switches of the other analog switch group might be turned ON before the analog switches of one analog switch group are perfectly turned OFF.

In such a case, a problem arises in that the matrix lines are short-circuited before they are respectively disconnected from the outputs of the drivers, or the matrix lines are respectively connected to the outputs of the drivers before the short circuit of the matrix lines are cut off, whereby the outputs of the drivers are instantaneously short-circuited to cause a flow of overcurrent, thus no obtaining the original effect of the precharge operation.

SUMMARY OF THE INVENTION

The present invention has been made to resolve such a conventional problem. Therefore, an object of the present invention is to provide a liquid crystal drive circuit capable of preventing overcurrent developed upon precharge and a liquid crystal driving method.

According to one aspect of the present invention, for achieving the above object, there is provided a drive circuit for driving matrix lines of a matrix line group of a liquid crystal device and formed on a semiconductor chip, comprising:

a driver group having a plurality of drivers, each of which outputs a drive signal, the driver group being formed on a central region of the semiconductor chip a first switch group having a plurality of first switches, each of which has conductive and non-conductive states, the first switch connecting an output of the driver to the matrix line in the conductive state and disconnecting the output of the driver from the matrix line in the non-conductive state, the first switch group being formed on the central region of the semiconductor chip;

a second switch group having a plurality of second switches, each of which has conductive and non-conductive states, the second switch connecting the matrix line to a precharge power supply in the conductive state and disconnecting the precharge power supply in the non-conductive state, the second switch group being formed on the central region of the semiconductor chip; and a switch control circuit which controls the conductive states of the first and second switch groups and formed on a peripheral region of the semiconductor chip, wherein the switch control circuit sets the second switches to the conductive state when detecting all first switches of the first switch group have been made non-conductive states, and sets the first switches to the conductive state when detecting all second switches of the second switch group have been made non-conductive states.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DESCRIPTION OF TIRE PREFERRED EMBODIMENT

Preferred embodiments of the present invention will hereinafter be described in detail with reference to the accompanying drawings.

First Embodiment

Figure 1:
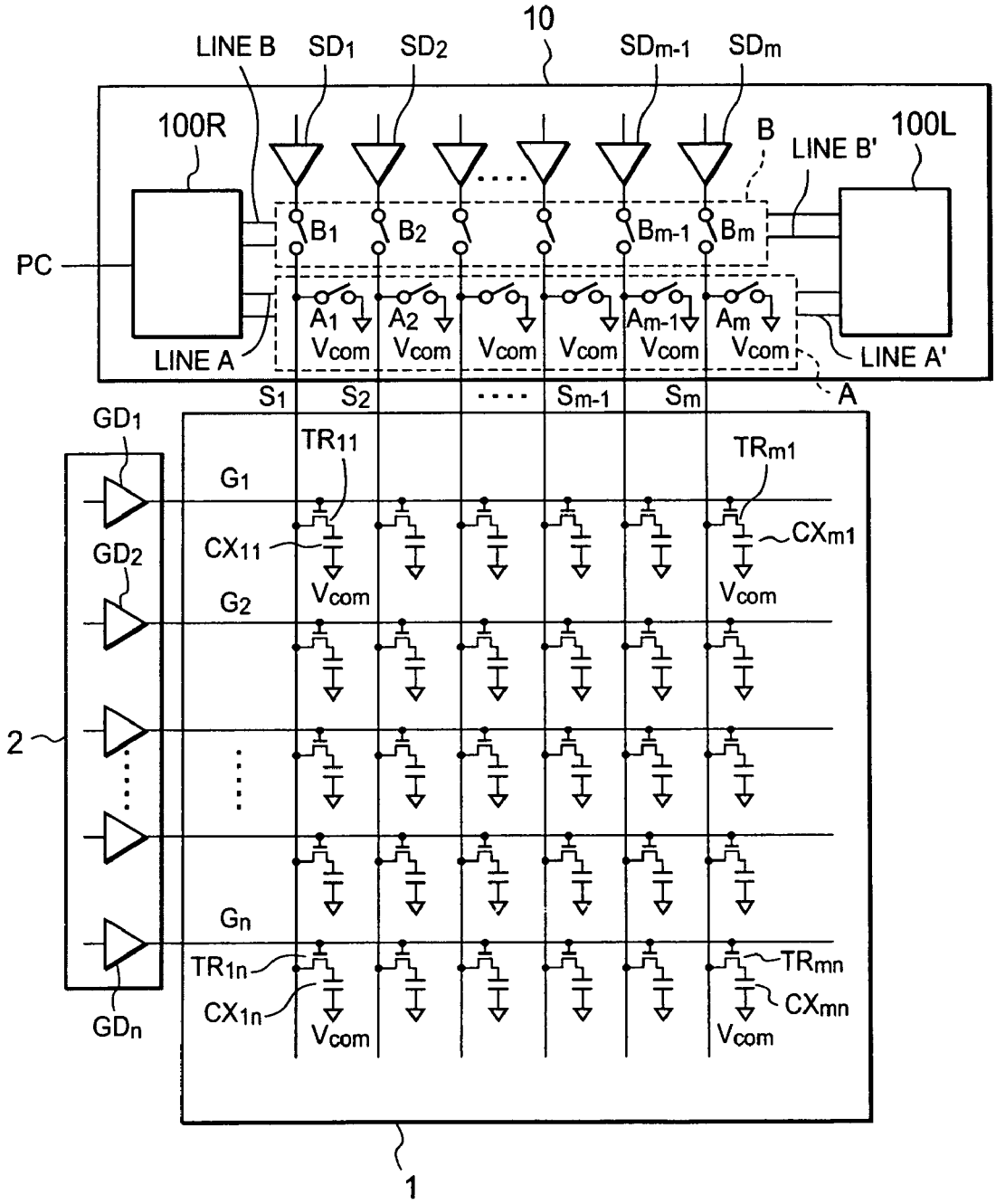
FIG. 1 is a configurational diagram of a liquid crystal display according to a first embodiment of the present invention.
Figure 14:
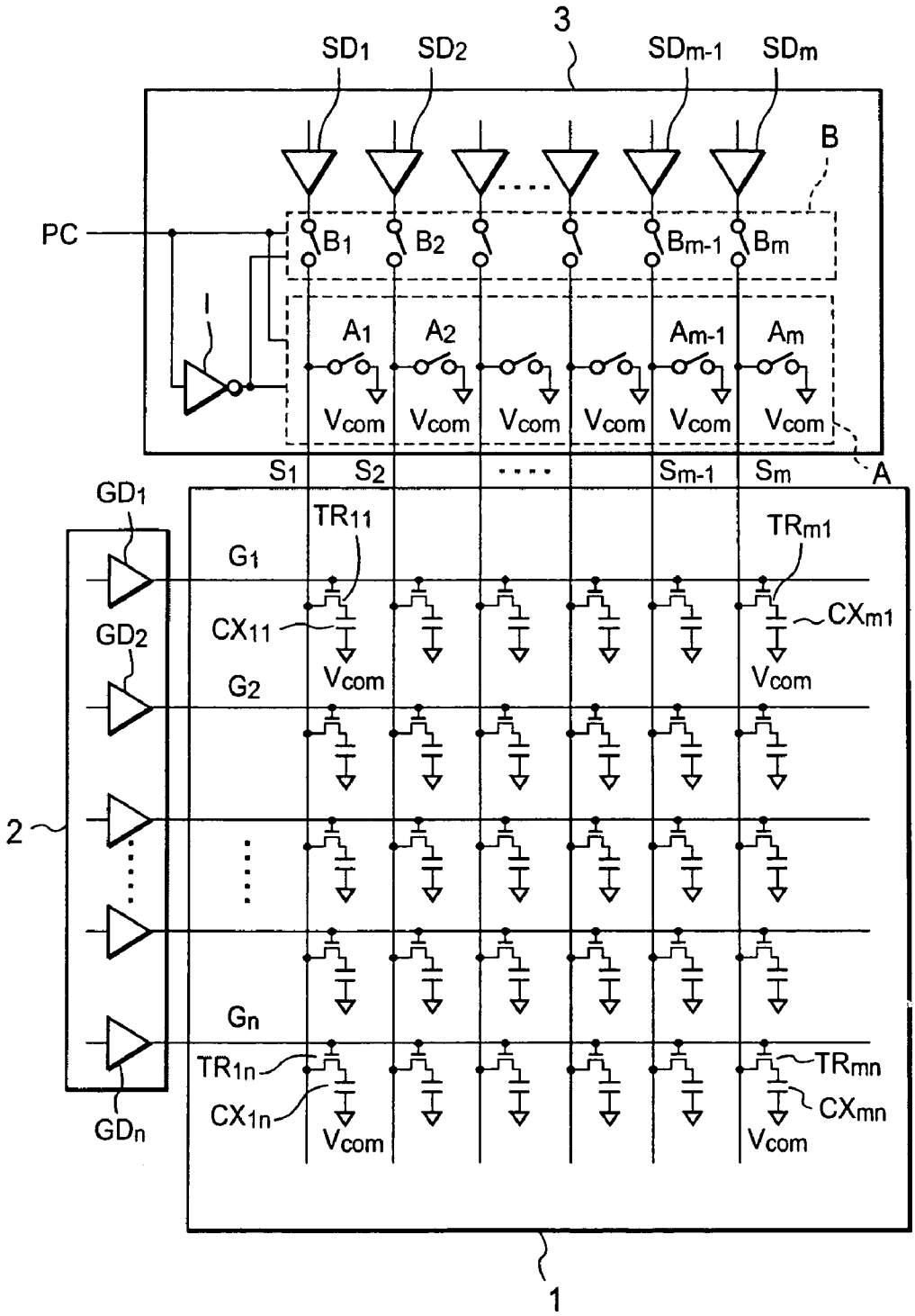
FIG. 14 is a configurational diagram of a conventional liquid crystal display.

FIG. 1 is a configurational diagram showing a liquid crystal display of a first embodiment of the present invention. Elements of structure similar to those shown in FIG. 14 are respectively identified by the same reference numerals. The liquid crystal display according to the first embodiment comprises a liquid crystal panel 1, a gate drive circuit 2, a source drive circuit 10 of the first embodiment, a source line group, and a gate line group.

[Matrix Line Group]

The source line group comprises m (where m: arbitrary integer greater than or equal to 2) source lines $S_1, S_2, \ldots, S_m$. The gate line group comprises n (where n: arbitrary integer greater than or equal to 2) gate lines $G_1, G_2, \ldots, G_n$. These source line and gate line groups constitute a matrix line group for driving switch transistors of m×n liquid crystal cells arranged in matrix form.

[Liquid Crystal Panel 1]

The liquid crystal panel 1 comprises m×n switch transistors $TR_{11}, TR_{21}, \ldots, TR_{m1}, TR_{12}, TR_{22}, \ldots TR_{m2}, \ldots TR_{1n}, TR_{2n}, \ldots, TR_{mn}$, and m×n liquid crystal cell capacitors $CX_{11}, CX_{21}, \ldots, CX_{m1}, CX_{12}, CX_{22}, \ldots, CX_{m2}, \ldots, CX_{1n}, CX_{2n}, \ldots, CX_{mn}$. The switch transistors $TR_{ij}$ (where i: any of integers from 1 to m, and j: any of integers from 1 to n), and the liquid cell capacitor $CX_{ij}$ constitute each individual liquid crystal cell. These m×n liquid crystal cells are arranged in the liquid crystal panel in matrix form.

The source and drain of the switch transistor $TR_{ij}$ are connected between the source line $S_i$ and a cell electrode of the liquid crystal cell capacitor $CX_{ij}$. The gate of the switch transistor $TR_{ij}$ is connected to its corresponding gate line $G_j$. A common electrode of the liquid crystal cell capacitor $CX_{ij}$ is connected to a common power supply $V_{com}$.

[Gate Drive Circuit 2]

The gate drive circuit 2 is equipped with n gate drivers $GD_1, GD_2, \ldots, GD_n$. The gate drive circuit 2 drives the gate line $G_j$ of the gate line group by means of the gate driver $GD_j$.

Figure 2:
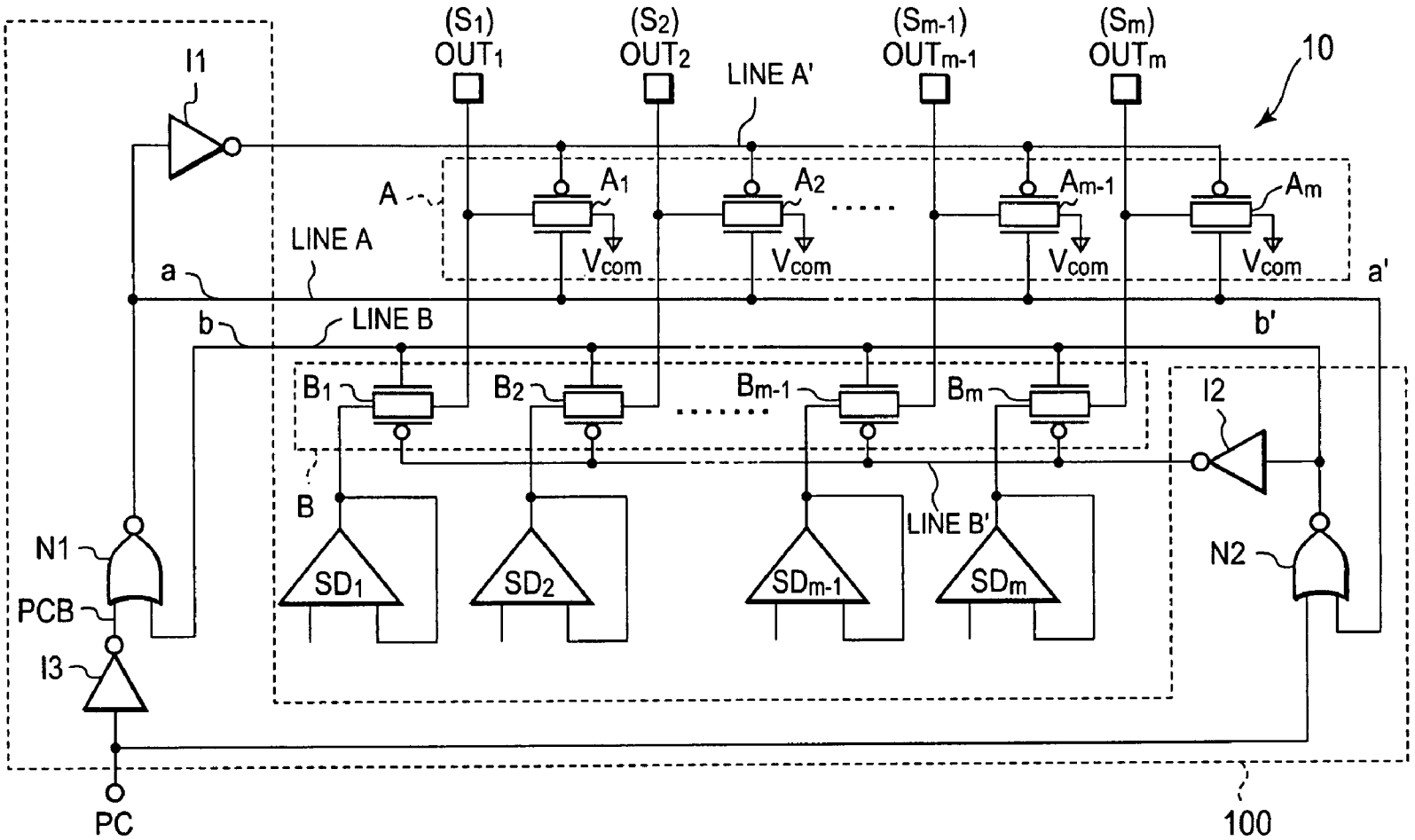
FIG. 2 is a circuit configurational diagram showing a source drive circuit of the first embodiment of the present invention.
Figure 15:
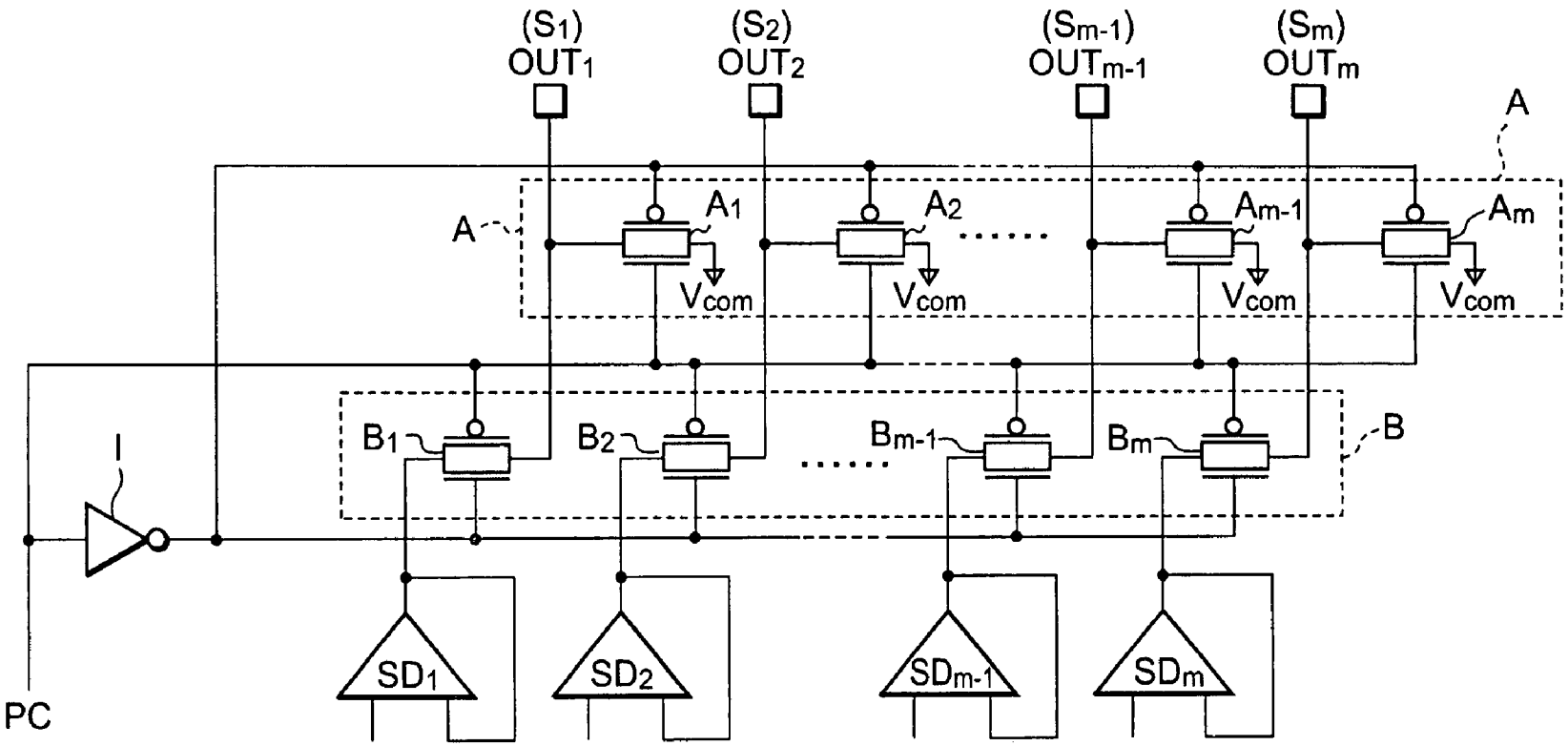
FIG. 15 is a circuit configurational diagram of a conventional source drive circuit.

FIG. 2 is a circuit configurational diagram showing the source drive circuit 10 of the first embodiment. Elements of structure similar to those shown in FIG. 15 are respectively identified by the same reference numerals.

[Source Drive Circuit 10]

Figure 17:
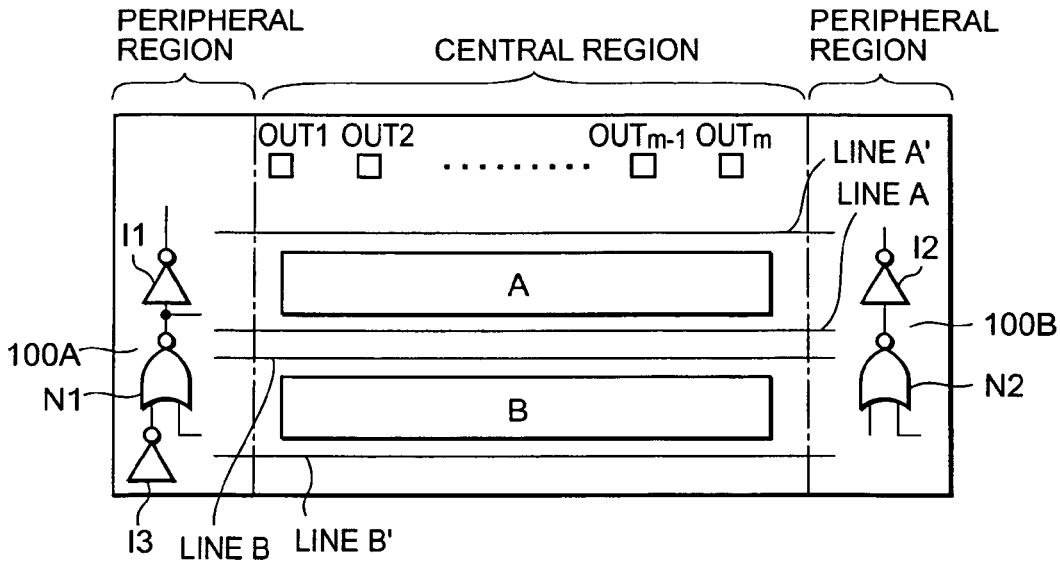
FIG. 17 is a schematic layout on a semiconductor chip of a liquid crystal display according to a first embodiment of the present invention.

As shown in FIGS. 1 and 2, the source drive circuit 10 of the first embodiment includes a source driver group, an analog switch group A, an analog switch group B and a switch control circuit 100. The source drive circuit 10 is formed on a semiconductor chip. FIG. 17 shows a schematic layout of the analog switch group A, the analog switch group B, the switch control circuit 100, a signal line A, signal line A', a signal line B, and a signal line B' on the semiconductor chip. Usually, since the source drive circuit has from several tens of output terminals to one hundred and several tens of output terminals, the length of one pair of sides of the semiconductor chip is longer than the other pair of sides of the semiconductor chip. That is, the semiconductor chip including the source drive circuit has a rectangular shape.

[Source Driver Group]

The source driver group comprises m source drivers $SD_1, SD_2, \ldots, SD_m$. The source driver group drives the corresponding source line $S_i$ of the source line group by means of the source driver $SD_i$.

[Analog Switch Group A]

The analog switch group A comprises m analog switches (MOS switches) $A_1, A_2, \ldots, A_m$. The analog switch $A_i$ is provided between an output terminal $OUT_i$ (source line $S_i$) of the source drive circuit 10 and the common power supply $V_{com}$ (potential at the common electrode of each liquid crystal cell capacitor). The analog switch $A_i$ short circuits the output terminal $OUT_i$ (source line $S_i$) to the common power supply $V_{com}$ and disconnects it from the common power supply $V_{com}$ in accordance with signal levels applied to the signal lines a and a', respectively. A position on the signal line A located near the output terminal of the NOR gate N1 is shown as position a. A position on the signal line A located near the input terminal of the NOR gate N2 is shown as position a'. The signal line A is provided in a direction in which the output terminals OUT are arranged. That is, the signal line A is extended in a direction parallel to the long side of the semiconductor chip. The point a is located at a left side of the semiconductor chip and the point a' is located at a right side of the semiconductor chip. In the first embodiment, a precharge power supply for short-circuiting each output terminal (source line) of the source drive circuit for the purpose of precharge is set as the common power supply $V_{com}$.

[Analog Switch Group B]

The analog switch group B comprises m analog switches (MOS switches) $B_1$, $B_2$, . . . , $B_m$. The analog switch $B_i$ is provided between the output of the source driver $SD_i$ and the output terminal $OUT_i$ (source line $S_i$ of the source drive circuit 10. The analog switch $B_i$ connects the output terminal $OUT_i$ (source line $S_i$) to the output of the source diver $SD_i$ and disconnects it from the output of the source driver $SD_i$ in accordance with signal levels of the signal line B and B', respectively. A position on the signal line B located near the input terminal of the NOR gate N1 is shown as position b. A position on the signal line B located near the output terminal of the NOR gate N2 is shown as position b'. The signal line B is provided in the direction in which the output terminals OUT are arranged. That is, the signal line B is extended in the direction parallel to the long side of the semiconductor chip. The point b is located at the left side of the semiconductor chip and the point b' is located at the right side of the semiconductor chip.

[Switch Control Circuit 100]

As shown in FIG. 2, the switch control circuit 100 includes NOR gates N1 and N2, and inverters I1, I2 and I3. The switch control circuit 100 controls switch operations of the analog switch groups A and B in accordance with an input signal PC.

The input signal PC is inputted to the NOR gate N1 and the inverter I3. The output of the inverter I3 is connected to the input of the NOR gate N1. The input signal PC is a control signal which triggers the switch operations of the analog switch groups A and B.

The output of the NOR gate N1 is connected to the input of the inverter I1, the input of the NOR gate N2 and the gates of NMOSs of the analog switches $A_1$ through $A_m$. Also the output of the inverter I1 is connected to the gates of PMOSs of the analog switches $A_1$ through $A_m$.

The output of the NOR gate N2 is connected to the input of the inverter I2, the input of the NOR gate N1 and the gates of NMOSs of the analog switches $B_1$ through $B_m$. Also the output of the inverter I2 is connected to the gates of PMOSs of the analog switches $B_1$ through $B_m$.

Figure 18:
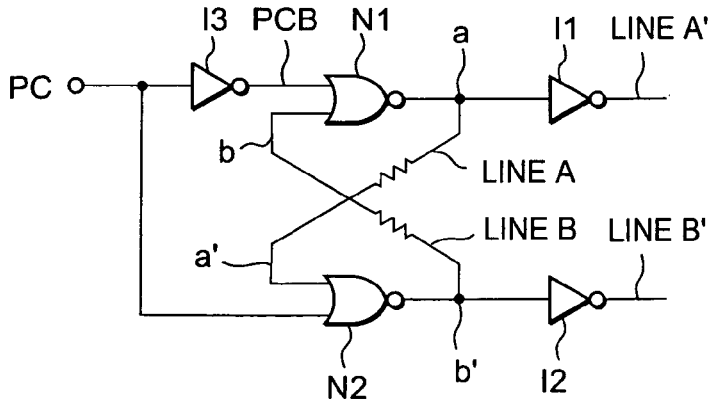
FIG. 18 is a circuit diagram showing a switch control circuit according to a first embodiment of the present invention.

In the switch control circuit 100, the NOR gates N1 and N2 and the inverter I3 constitute a flip-flop circuit. The analog switches $A_1$ through $A_m$ of the analog switch group A are turned OFF when the signals appeared on the point a (output signal of NOR gate N1) and the point a' (input signal of NOR gate N2) of the signal line Line A are "0", and are turned ON when the signals appeared on the point a and the point a' are "1". Further, the analog switches $B_1$ through $B_m$ of the analog switch group B are turned OFF when the signals appeared on the point b' (output signal of NOR gate N2) and the point b (input signal of NOR gate N1) of the signal line Line B are "0", and are turned ON when the signals appeared on the point b' and the point b are "1". As shown in FIG. 1 and FIG. 17, the switch control circuit 100 is separated into two regions on the semiconductor chip. In detail, a 100L which is a potion of the switch control circuit 100 including the NOR gate N1 and the inverter I3 is arranged on a peripheral region 100A which is the left side of the semiconductor chip. A 100R which is a potion of the switch control circuit 100 including the NOR gate N2 is arranged on a peripheral region 100B which is the right side of the semiconductor chip. The signal line Line A and Line B for connecting the NOR gate N1 to the NOR gate N2 are provided over the central region between the peripheral region 100A and the peripheral region 100 B. Therefore, as shown in FIG. 18, resistance and wiring capacitance is existed in the signal line Line A. Further, parasitic capacitance is added to the signal line Line A between the point a and the point a'. Resistance and wiring capacitance is existed in the signal line Line B as well. Further, parasitic capacitance is added to the signal line Line B between the point b and the point b'. Since the switch control circuit 100 is separated into the two portions across the analog switch groups A and B and the length of the signal line Line A is equal to the length of the signal line Line B, the resistance value, the wiring capacitance and the parasitic capacitance of the signal line Line A and Line B are set to the same value.

[Operation of First Embodiment]

Figure 3:
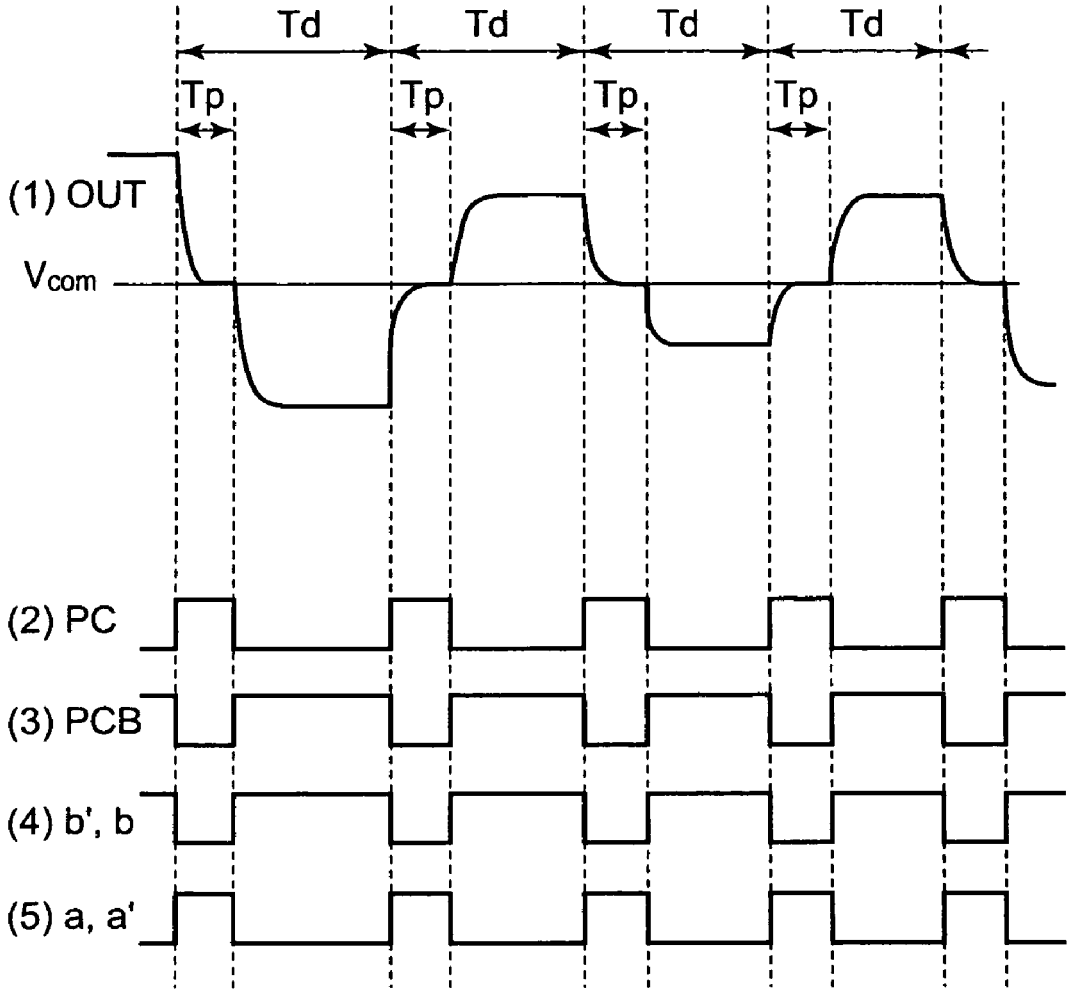
FIG. 3 is a timing chart at 1-dot inversion driving of the source drive circuit of the first embodiment of the present invention.

FIG. 3 is a timing chart at 1-dot inversion driving of the source drive circuit 10 of the first embodiment of the present invention. In FIG. 3, reference numeral (1) indicates an output signal OUT ($OUT_i$ ($S_i$) in FIG. 2) of the source drive circuit 10, reference numeral (2) indicates an input signal PC, reference numeral (3) indicates a signal PCB, reference numeral (4) indicates a wave form at point b and b' of the signal line Line B, and reference numeral (5) indicates a wave form at point a and a' of the signal line Line A, respectively. In addition, Td indicates a 1-dot period of the liquid crystal display, and Tp indicates a precharge period, respectively.

Figure 4:
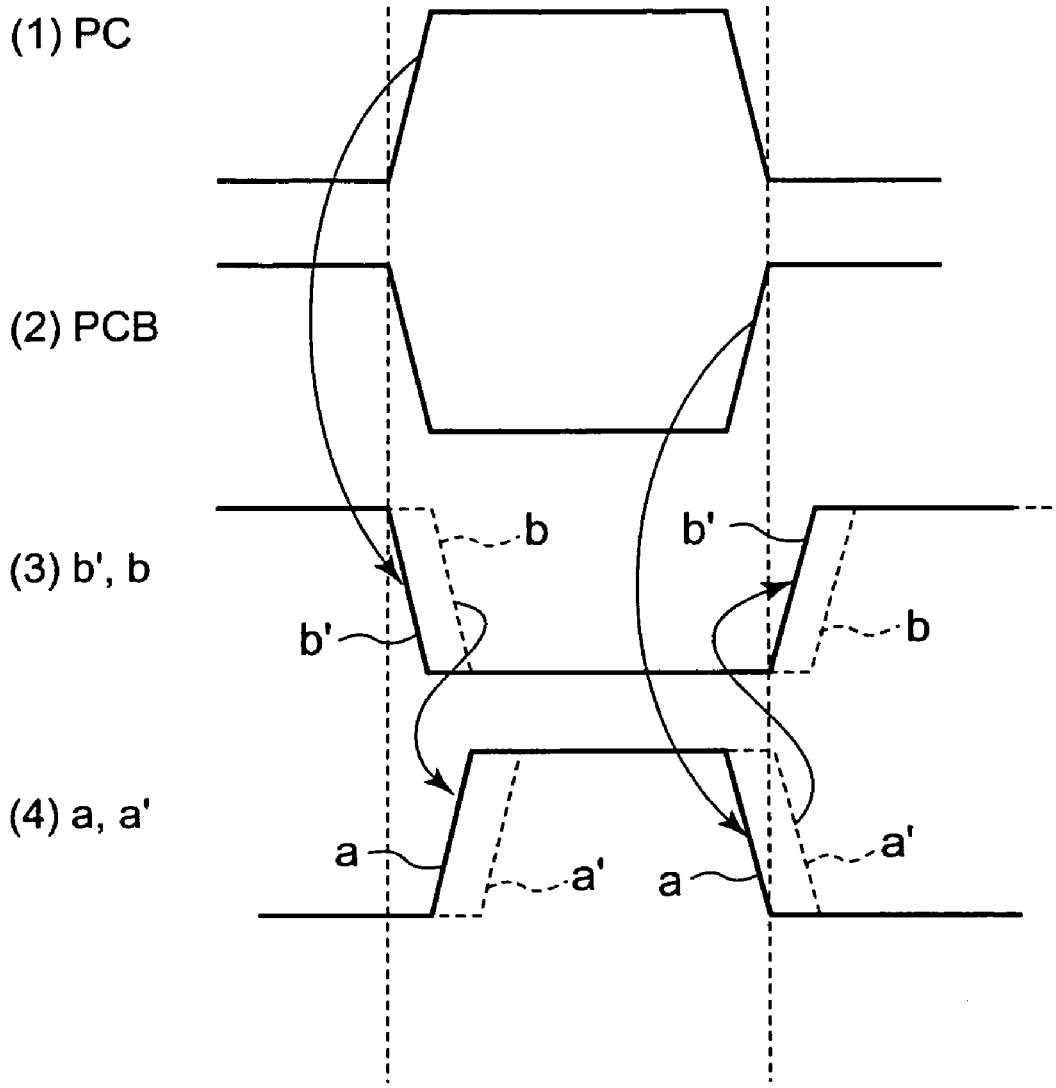
FIG. 4 is an enlarged view of a precharge period in FIG. 3.

FIG. 4 is an enlarged view of the precharge period Tp in FIG. 3. In FIG. 4, reference numeral (1) indicates the input signal PC, reference numeral (2) indicates the signal PCB, reference numeral (3) indicates a wave form of the point b' and b of the signal line LineB, and reference numeral (4) indicates a wave form of the point a and a' of the signal line Line A, respectively.

The operation of the source drive circuit 10 of the first embodiment will be explained below with reference to FIGS. 3 and 4. Incidentally, in the following description, logic "0" indicates an "L" level and logic "1" indicates an "H" level.

[Driver Output Period]

During a driver output period, the input signal PC (input signal of NOR gate N2 and inverter I3) is "0", and the signal PCB (input signal of NOR gate N1 and output signal of inverter I3) is "1". Thus, since the point a (output signal of NOR gate N1) and the point a' (input signal of NOR gate N2) is "0", and the output signal of the inverter I1 is "1", the analog switch group A is held OFF so that the output terminals $OUT_1$ through $OUT_m$ (source lines $S_1$ through $S_m$) of the source drive circuit 10 are disconnected from the common power supply $V_{com}$.

Further, since the point b' (output signal of NOR gate N2) and the point b (input signal of NOR gate N1) are "1", and the output signal of the inverter I2 is "0", the analog switch group B is held ON so that the output terminals $OUT_1$ through $OUT_m$ (source lines $S_1$ through $S_m$) of the source drive circuit 10 are respectively connected to the outputs of the source drivers $SD_1$ through $SD_m$. Thus, the output signals of the source drivers $SD_1$ through $SD_m$ are outputted to their corresponding source lines $S_1$ through $S_m$.

[Operation for Switching from Driver Output Period to Precharge Period]

Next, when the input signal PC is brought to "1", the point b' reaches "0" at first, and the signal b also becomes "0" with being delayed due to wiring capacitance or the like (see FIGS. 4(1) and 4(3)). Since the output signal of the inverter I2 is also brought to "1" in like manner, the analog switch group B is turned OFF so that the output terminals $OUT_1$ through $OUT_m$ (source lines $S_1$ through $S_m$) of the source drive circuit 10 are respectively disconnected from the outputs of the source drivers $SD_1$ through $SD_m$) thus resulting in high impedance.

When the input signal PC is brought to "1", the signal PCB reaches "0" (see FIGS. 4(1) and 4(2)). When the signal PCB is "0" and the point b becomes "0", the point a reaches "1" at first and the point a' also becomes "1" with being delayed due to wiring capacitance or the like (see FIGS. 4(3) and 4(4)). Since the output signal of the inverter I1 also becomes "0" similarly, the analog switch group A is turned ON so that the output terminals $OUT_1$ through $OUT_m$ (source lines $S_1$ through $S_m$) of the source drive circuit 10 are short-circuited to the common power supply $V_{com}$.

When the point b is brought to "1", the analog switch group B is all already held OFF. Thus, since the point a is not brought to "1" unless the point b reaches "0" even if the signal PCB is brought to "0" in the switch control circuit 100, the analog switch group B is all turned OFF. Unless the source line group is all disconnected from the source driver group, the analog switch group A is not brought to ON and the source line group is not short-circuited to the common power supply $V_{com}$. That is, the switch control circuit 100 detects that the signal PCB has reached "0" (the input signal PC has been brought to "1") and the point b has reached "0" (that is, the analog switch group B has all been brought to OFF) and thereafter brings the point a to "1" to turn ON the analog switch group A.

[Precharge Period]

During the precharge period, the input signal PC (input signal of NOR gate N2 and inverter I3) is "1" and the signal PCB (input signal of NOR gate N1 and output signal of inverter I3) is "0". Thus, since the point b' (output signal of NOR gate N2) and the point b (input signal of NOR gate N1) are "0" and the output signal of the inverter I2 is "1", the analog switch group B is held OFF and hence the output terminals $OUT_1$ through $OUT_m$ (source lines $S_1$ through $S_m$) of the source drive circuit 10 are respectively disconnected from the source drivers $SD_1$ through $SD_m$.

Since the point a (output signal of NOR gate N1) and the point a' (input signal of NOR gate N2) are "1", the analog switch group A is held ON and hence the output terminals $OUT_1$ through $OUT_m$ (source lines $S_1$ through $S_m$) of the source drive circuit 10 are short-circuited to the common power supply $V_{com}$, whereby precharge is carried out.

[Operation for Switching from Precharge Period to Driver Output Period]

Next, when the input signal PC is brought to "0", the signal PCB reaches "1" (see FIGS. 4(1) and 4(2)). When the signal PCB is brought to "1", the point a reaches "0" at first and the point a' also becomes "0" with being delayed due to wiring capacitance or the like (see FIGS. 4(2) and 4(4)). Since the output signal of the inverter I1 is also brought to "1" in like manner, the analog switch group A is turned OFF so that the output terminals $OUT_1$ through $OUT_m$ (source lines $S_1$ through $S_m$) of the source drive circuit 10 are disconnected from the common power supply $V_{com}$, thus resulting in high impedance.

When the signal PC is "0" and the point a' reaches "0", the point b' is brought to "1" and the point b also becomes "1" with being delayed due to wiring capacitance or the like (see FIGS. 4(4) and 4(3)). Since the output signal of the inverter I2 also becomes "0" in like manner, the analog switch group B is turned ON so that the output terminals $OUT_1$ through $OUT_m$ (source lines $S_1$ through $S_m$) of the source drive circuit 10 are respectively connected to the outputs of the source drivers $SD_1$ through $SD_m$. Thus, the output signals of the source drivers $SD_1$ through $SD_m$ are respectively outputted to the source lines $S_1$ through $S_m$.

When the point a' is brought to "0", the analog switch group A is all already held OFF. Thus, since the point b' is not brought to "1" unless the point a' reaches "0" even if the signal PC is brought to "0" in the switch control circuit 100, the analog switch group A is all turned OFF. Unless the source line group is all disconnected from the common power supply $V_{com}$ the analog switch group B is not brought to ON and hence the source line group is not connected to the outputs of the source driver group. That is, the switch control circuit 100 detects that the signal PC has reached "0" and the point a' has reached "0" (that is, the analog switch group A has all been turned OFF) and thereafter brings the point b' to "1" to turn ON the analog switch group B.

According to the first embodiment as described above, the switch control circuit 100 detects that the analog switch group B has been all turned OFF and thereafter turns ON the analog switch group A, and detects that the analog switch group A has been all turned OFF and thereafter turns ON the analog switch group B. Thus, the output terminals $OUT_1$ through $OUT_m$ (source lines $S_1$ through $S_m$) of the source drive circuit 10 are disconnected from the outputs of the source driver group or the common power supply $V_{com}$, thus definitely resulting in high impedance for a moment, followed by being connected to the common power supply $V_{com}$ or the outputs of the source driver group. It is, therefore, possible to prevent overcurrent developed between the outputs of the source driver group and the common power supply $V_{com}$ upon precharge and realize liquid crystal driving of low power consumption at high speed, which exhibits the original effect of the precharge.

Since the flip-flop circuit detects that the analog switch group has been all brought to OFF, the amount of a delay due to the resistance/capacitance can automatically be complemented.

Further, according to the first embodiment, the flip-flop circuit of the switch control circuit is divided into two regions on the semiconductor chip so as to across the analog switch groups. As a result, resistance value, wiring capacitance and parasitic capacitance of the wrings (signal lines Line A and Line B) which connect between the divided elements of the flip-flop circuit are set to the same value. Therefore, time period in which the analog switch group A is brought to the OFF state (time period between the time when the point a is changed to "0" and the time when the point a' is changed to "0") and the time period in which the analog switch group B is brought to the OFF state (time period between the time when the point b' is changed to "0" and the time when the point b is changed to "0") can be set to substantially the same value without using a particular circuit. Therefore, the situation that the two switch groups are conductive states (ON state) at the same time can be prevented. Also, high speed operation can be obtained easily.

Second Embodiment

Figure 5:
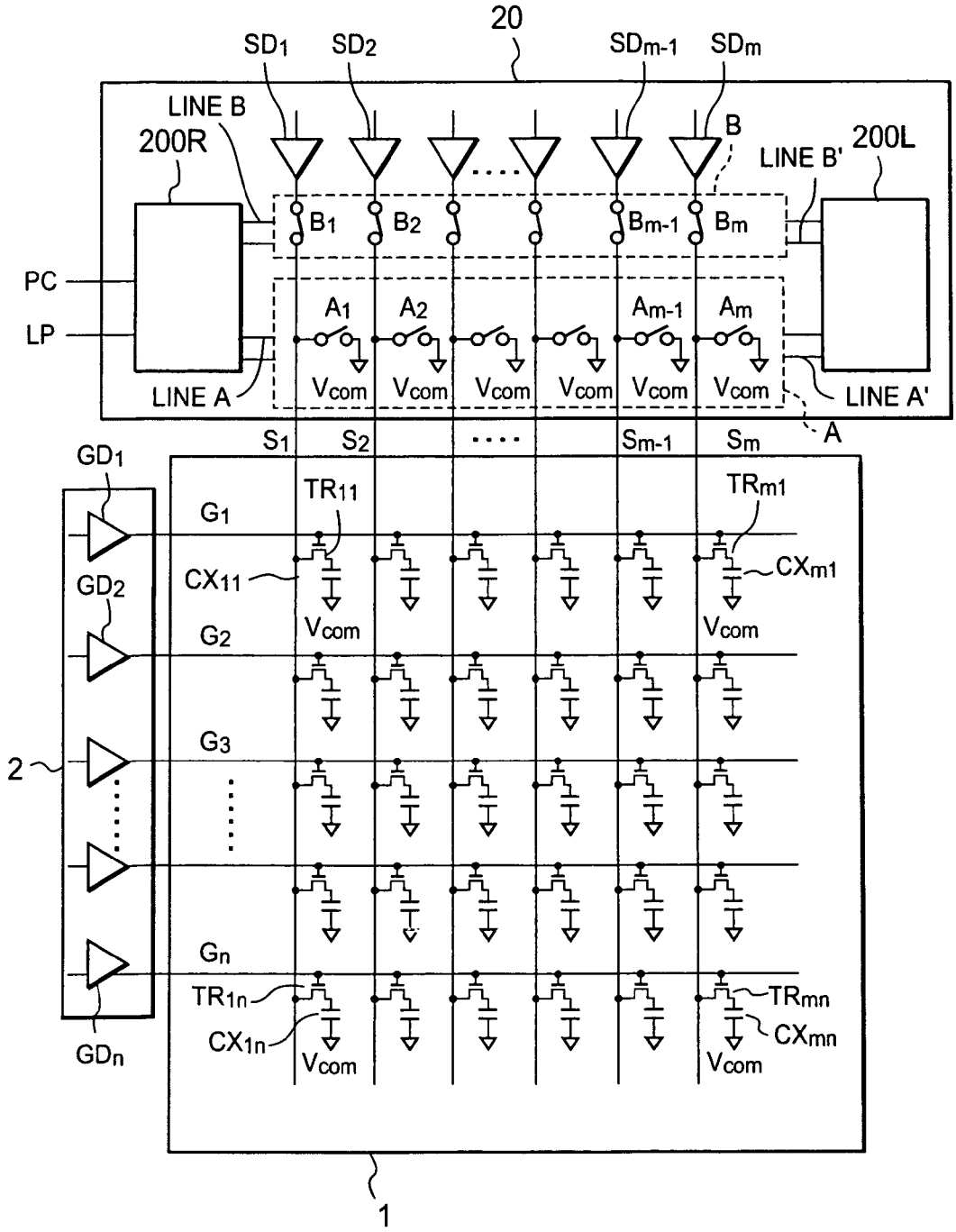
FIG. 5 is a configurational diagram of a liquid crystal display according to a second embodiment of the present invention.
Figure 6:
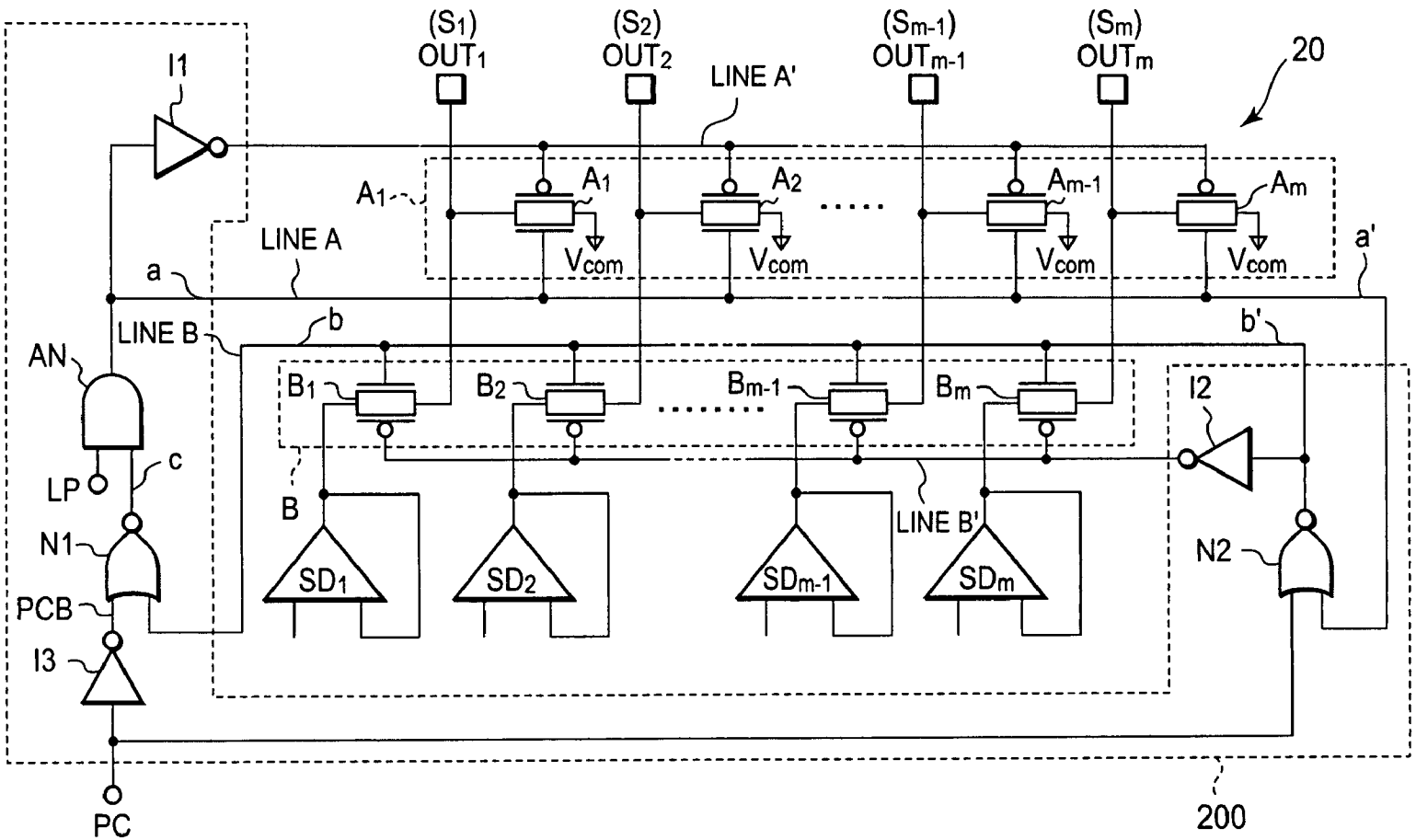
FIG. 6 is a circuit configurational diagram showing a source drive circuit of the second embodiment of the present invention.

FIG. 5 is a configurational diagram showing a liquid crystal display according to a second embodiment of the present invention. Elements of structure similar to those shown in FIG. 1 are respectively identified by the same reference numerals. FIG. 6 is a circuit configurational diagram showing a source drive circuit 20 of the second embodiment of the present invention. Elements of structure identical to those shown in FIG. 2 are respectively identified by the same reference numerals.

The liquid crystal display according to the second embodiment shown in FIG. 5 includes a liquid crystal panel 1, a gate drive circuit 2, the source drive circuit 20 of the second embodiment, a source line group and a gate line group. The liquid crystal display according to the second embodiment has a configuration wherein in the liquid crystal display (see FIG. 1) according to the first embodiment, the source drive circuit 10 is provided as the source drive circuit 20.

[Source Drive Circuit 20]

As shown in FIGS. 5 and 6, the source drive circuit 20 of the second embodiment includes a source driver group, an analog switch group A, an analog switch group B and a switch control circuit 200. The source drive circuit 20 has a configuration wherein in the source drive circuit 10 (see FIGS. 1 and 2) of the first embodiment, the source drive control circuit 100 is provided as the source drive control circuit 200.

[Switch Control Circuit 200]

As shown in FIG. 6, the switch control circuit 200 includes NOR gates N1 and N2, inverters I1, I2 and I3 and an AND gate AN and controls switch operations of the analog switch groups A and B in accordance with two input signals PC and LP. The switch control circuit 200 has a configuration wherein in the switch control circuit 100 of the first embodiment (see FIG. 1), the AND gate AN inputted with the signal LP is provided. The AND gate AN is provided on the left side peripheral region of the semiconductor chip as shown in FIG. 17. That is, the AND gate AN is provide on the peripheral region 100A.

The AND gate AN outputs a signal to the point a with the input signal LP and a signal appeared at a point c (output signal of NOR gate N1) as inputs. The input signal LP is a control signal which permits/inhibits ON operations of the analog switch group A.

[Operation of Second Embodiment]

Figure 7:
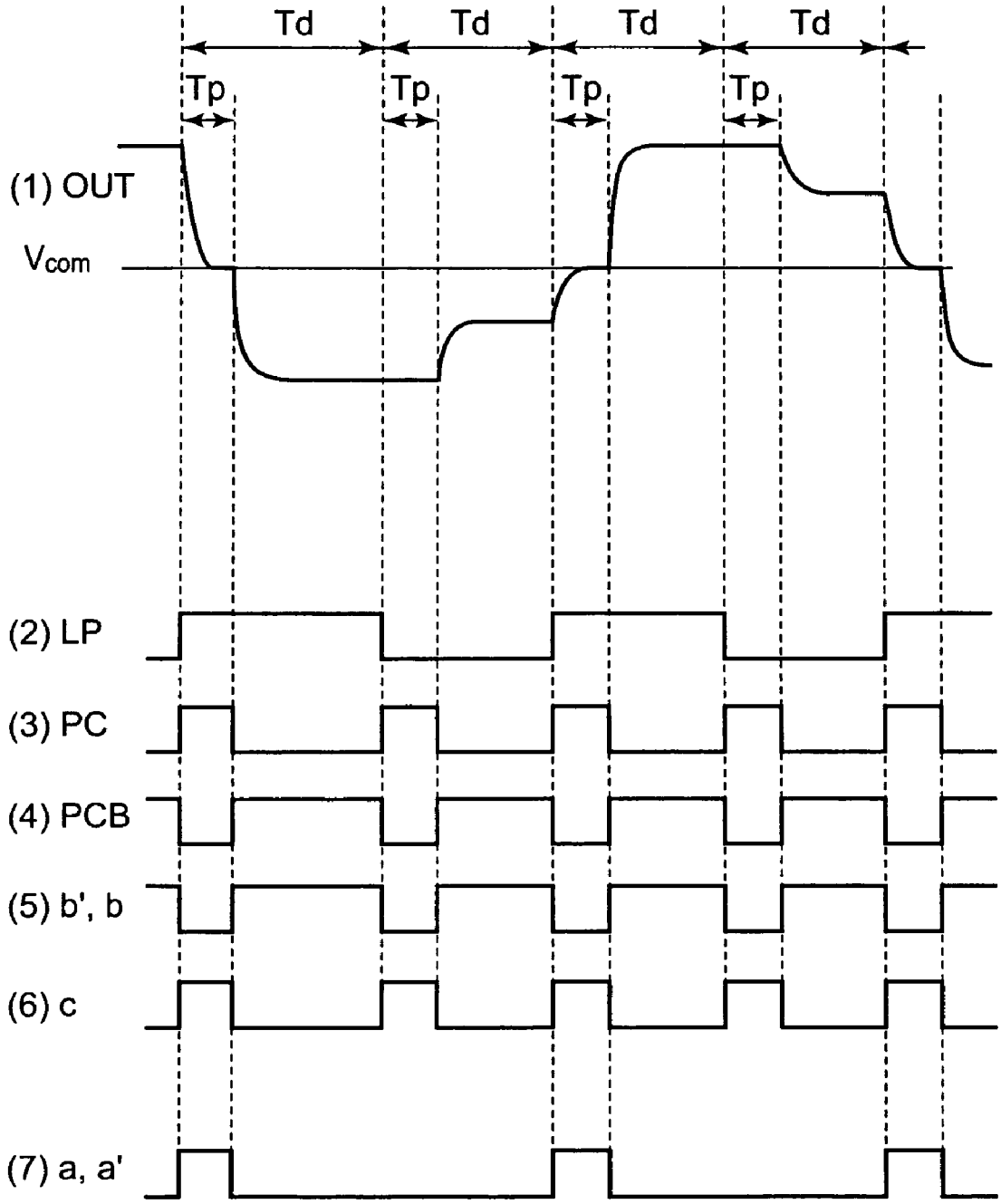
FIG. 7 is a timing chart at 2-dot inversion driving of the source drive circuit of the second embodiment of the present invention.

FIG. 7 is a timing chart at 2-dot inversion driving of the source drive circuit 20 of the second embodiment of the present invention. In FIG. 7, reference numeral (1) indicates an output signal OUT ($OUT_i$ ($S_i$) in FIG. 6) of the source drive circuit 20, reference numeral (2) indicates an input signal LP, reference numeral (3) indicates an input signal PC, reference numeral (4) indicates a signal PCB, reference numeral (5) indicates a wave form at the points b' and b of the signal line Line B, reference numeral (6) indicates a wave form at the point c (output of the NOR gate N1), and reference numeral (7) indicates wave form at the point a and a' of the signal line Line A, respectively. Further, Td indicates a 1-dot period of the liquid crystal display, and Tp indicates a precharge period, respectively.

Figure 8:
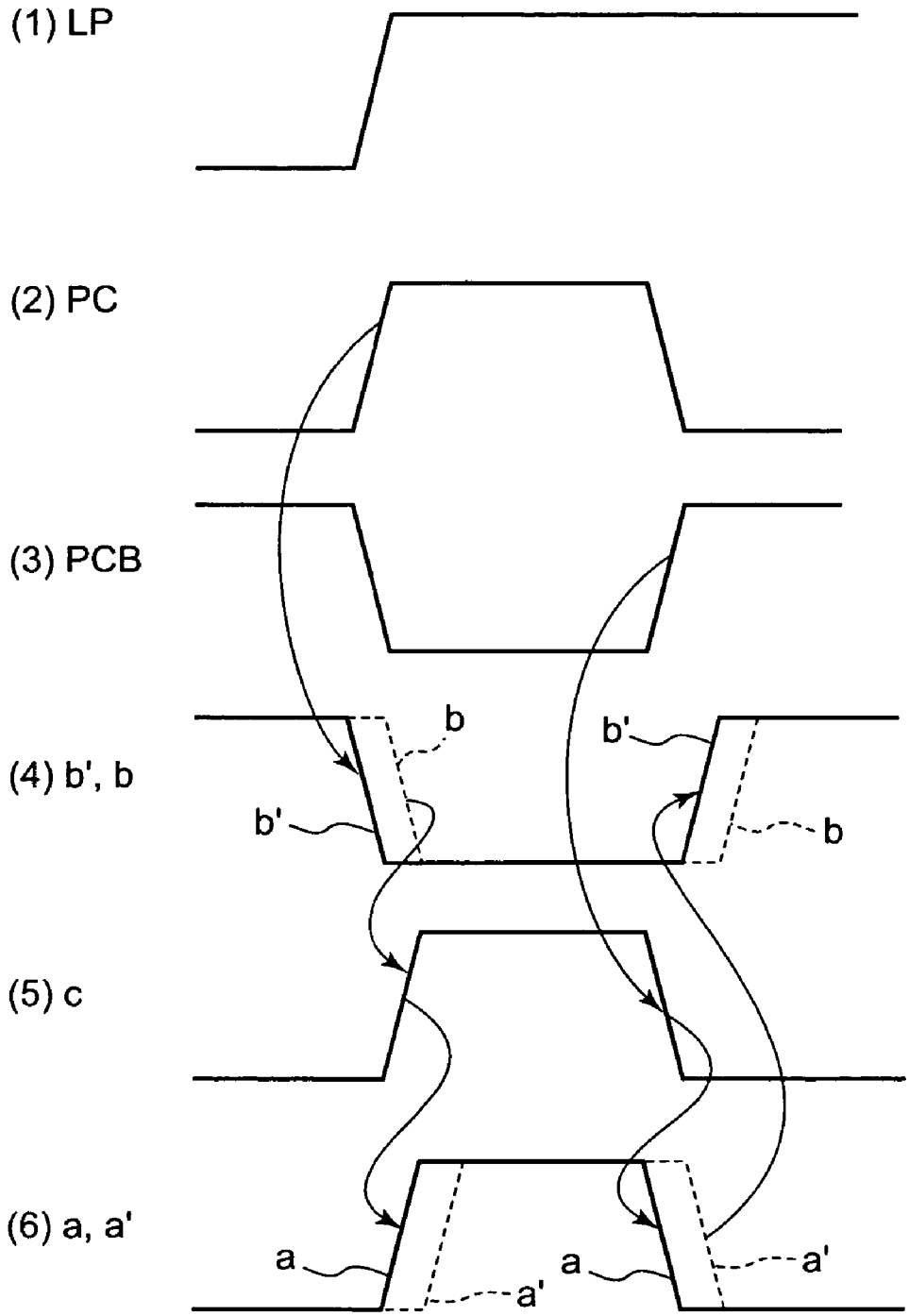
FIG. 8 is an enlarged view of a precharge period in FIG. 7.

FIG. 8 is an enlarged view of the precharge period Tp in FIG. 7. In FIG. 8, reference numeral (1) indicates the input signal LP, reference numeral (2) indicates the input signal PC, reference numeral (3) indicates the signal PCB, reference numeral (4) indicate the wave form at the signals b' and b of the signal line Line B, reference numeral (5) indicates a wave form at the point c and reference numeral (6) indicate a wave form at the point a and a' of the signal line Line A, respectively.

The operation of the source drive circuit 20 of the second embodiment will be explained below with reference to FIGS. 7 and 8. Incidentally, in the following description, logic "0" indicates an "L" level and logic "1" indicates an "H" level.

A basic operation of the source drive circuit 20 of the second embodiment is similar to the source drive circuit 10 of the first embodiment. The second embodiment is different from the first embodiment in that the switch control circuit 200 is capable of permitting inhibiting the ON operations of the analog switch group A in accordance with the input signal LP.

[Driver Output Period]

During a driver output period, the input signal PC (input signal of NOR gate N2 and inverter I3) is "0", the signal PCB (input signal of NOR gate N1 and output signal of inverter I3) is "1", and the point c (output signal of NOR gate N1) is "0". Thus, since the point a (output signal of AND gate AN) and the point a' (input signal of NOR gate N2) is "0", and the output signal of the inverter I1 is "1", the analog switch group A is held OFF so that output terminals $OUT_1$ through $OUT_m$ (source lines $S_1$ through $S_m$) of the source drive circuit 20 are disconnected from a common power supply $V_{com}$.

Further, since the point b' (output signal of NOR gate N2) and the point b (input signal of NOR gate N1) are "1", and the output signal of the inverter I2 is "0", the analog switch group B is held ON so that the output terminals $OUT_1$ through $OUT_m$ (source lines $S_1$ through $S_m$) of the source drive circuit 20 are connected to their corresponding outputs of source drivers $SD_1$ through $SD_m$. Thus, the output signals of the source drivers $SD_1$ through $SD_m$ are respectively outputted to the source lines $S_1$ through $S_m$.

[Operation for Switching from Driver Output Period to Precharge Period]

Next, when the input signal PC is brought to "1", the point b' reaches "0" at first, and the point b also becomes "0" with being delayed due to wiring capacitance or the like (see FIGS. 8(2) and 8(4)). Since the output signal of the inverter I2 is also brought to "1" in like manner, the analog switch group B is turned OFF so that the output terminals $OUT_1$ through $OUT_m$ (source lines $S_1$ through $S_m$) of the source drive circuit 20 are respectively disconnected from the outputs of the source drivers $SD_1$ through $SD_m$, thus resulting in high impedance.

When the input signal PC is brought to "1", the signal PCB reaches "0" (see FIGS. 8(2) and 8(3)). When the signal PCB is "0" and the point b becomes "0", the point c reaches "1" (see FIGS. 8(4) and 8(5)). If the input signal LP is "1" at this time (see FIG. 8(1)), the point a reaches "1" at first when the point c becomes "1", and the point a' also becomes "1" with being delayed due to wiring capacitance or the like (see FIGS. 8(5) and 8(6)). Since the output signal of the inverter I1 also becomes "0" similarly, the analog switch group A is turned ON so that the output terminals $OUT_1$ through $OUT_m$ (source lines $S_1$ through $S_m$) of the source drive circuit 20 are short-circuited to the common power supply $V_{com}$.

When the point b is now brought to "1", the analog switch group B is all held OFF. Thus, since the point a is not brought to "1" unless the signal b reaches "0" even if the signal PCB is brought to "0" in the switch control circuit 200, the analog switch group B is all turned OFF. Unless the source line group is all disconnected from the source driver group, the analog switch group A is not brought to ON and hence the source line group is not short-circuited to the common power supply $V_{com}$. That is, the switch control circuit 200 detects that the signal PCB has reached "0" and the signal b has reached "0" (that is, the analog switch group B has all been brought to OFF) and thereafter brings the signal a to "1" to turn ON the analog switch group A.

[Precharge Period]

During the precharge period, the input signal PC (input signal of NOR gate N2 and inverter I3) is "1" and the signal PCB (input signal of NOR gate N1 and output signal of inverter I3) is "0". Thus, since the point b' (output signal of NOR gate N2) and the point b (input signal of NOR gate N1)

are "0" and the output signal of the inverter I2 is "1", the analog switch group B is held OFF and hence the output terminals $OUT_1$ through $OUT_m$ (source lines $S_1$ through $S_m$) of the source drive circuit 20 are respectively disconnected from the outputs of the source drivers $SD_1$ through $SD_m$.

Since the point a (output signal of NOR gate N1) and the point a' (input signal of NOR gate N2) are "1" if the input signal LP is "1", the analog switch group A is held ON and hence the output terminals $OUT_1$ through $OUT_m$ (source lines $S_1$ through $S_m$) of the source drive circuit 20 are short-circuited to the common power supply $V_{com}$, whereby precharge is carried out.

[Operation for Switching from Precharge Period to Driver Output Period]

Next, when the input signal PC is brought to "0", the signal PCB reaches "1" (see FIGS. 8(2) and 8(3)). When the signal PCB is brought to "0", the point c reaches "0" (see FIGS. 8(3) and 8(5)). If the input signal LP is "1" at this time (see FIG. 8(1)), the point a reaches "0" at first when the point c is brought to "0", and the point a' also becomes "0" with being delayed due to wing capacitance or the like (see FIGS. 8(5) and 8(6)). Since the output signal of the inverter I1 is also brought to "1" in like manner, the analog switch group A is turned OFF so that the output terminals $OUT_1$ through $OUT_m$ (source lines $S_1$ through $S_m$) of the source drive circuit 20 are disconnected from the common power supply $V_{com}$, thus resulting in high impedance.

When the signal PC is "0" and the point a' reaches "0", the point b' is brought to "1" at first and the point b also becomes "1" with being delayed due to wiring capacitance or the like (see FIGS. 8(6) and 8(4)). Since the output signal of the inverter I2 also becomes "0" in like manner, the analog switch group B is turned ON so that the output terminals $OUT_1$ through $OUT_m$ (source lines $S_1$ through $S_m$) of the source drive circuit 20 are respectively connected to the outputs of the source drivers $SD_1$ through $SD_m$. Thus, the output signals of the source drivers $SD_1$ through $SD_m$ are respectively outputted to the source lines $S_1$ through $S_m$.

When the point a' is brought to "0", the analog switch group A is all already held OFF. Thus, since the point b' is not brought to "1" unless the point a' reaches "0" even if the signal PC is brought to "0" in the switch control circuit 200, the analog switch group A is all turned OFF. Unless the source line group is all disconnected from the common power supply $V_{com}$, the analog switch group B is not brought to ON and hence the source line group is not connected to the outputs of the source driver group. That is, the switch control circuit 200 detects that the signal PC has reached "0" and the point a' has reached "0" (that is, the analog switch group A has all been turned OFF) and thereafter brings the point b' to "1" to turn ON the analog switch group B.

Further, if the input signal LP is "0" during the precharge period in the switch control circuit 200, the points a and a' remain at "0" if the point c is brought to "1" (see FIG. 7(7)). Since the output signal of the inverter I1 remains at "1" in like manner, the analog switch group A remains OFF and hence the output terminals $OUT_1$ through $OUT_m$ (source lines $S_1$ through $S_m$) of the source drive circuit 20 remain disconnected from the common power supply $V_{com}$, thus resulting in no precharge (see FIG. 7(1)). Thus, the switch control circuit 200 is capable of controlling based on the input signal LP (control signal for permitting/inhibiting ON operations of the analog switch group A) whether the precharge operation should be done during the precharge period.

For instance, a polarity inversion signal or the like can be used as the input signal LP. Incidentally, if the input signal LP is fixed to "1", then the operation of the switch control circuit 200 becomes similar to that of the switch control circuit 100 of the first embodiment.

Figure 16:
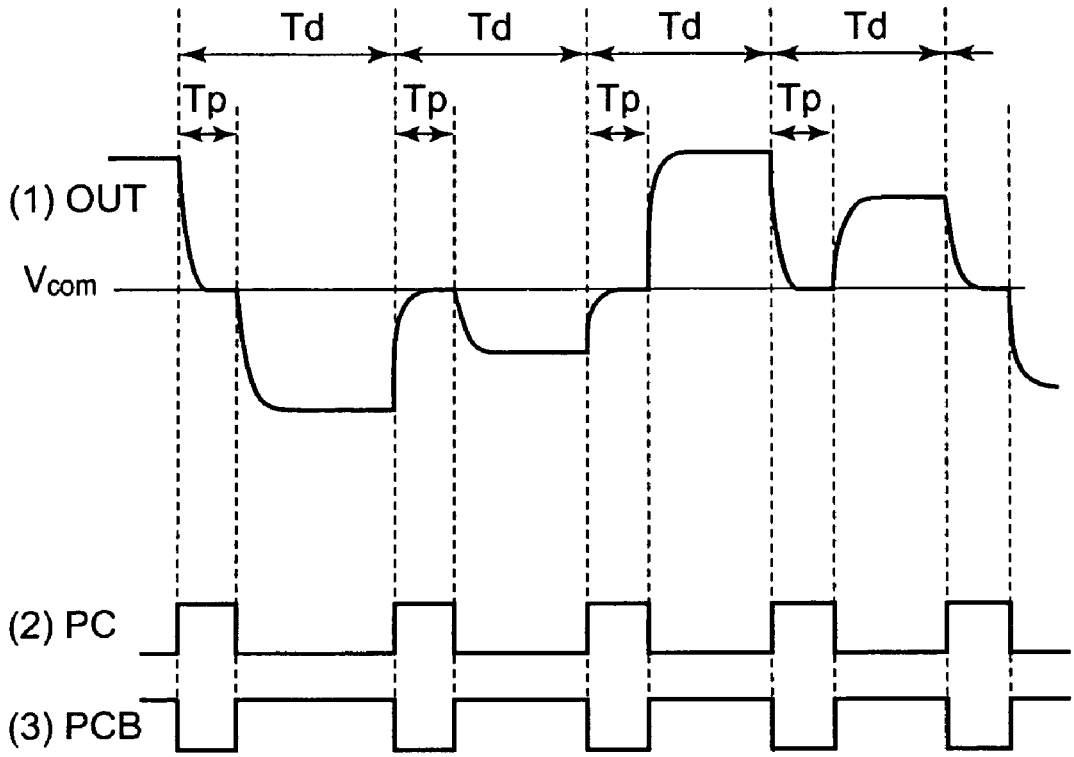
FIG. 16 is a timing chart at 2-dot inversion driving of the conventional source drive circuit.

FIG. 7 referred to above is a timing chart at the time that the polarity inversion signal is used as the input signal LP upon 2-dot inversion driving to thereby carry out a precharge operation only upon dot inversion. On the other hand, FIG. 16 is a timing chart at 2-dot inversion driving of the conventional source drive circuit 3 shown in FIG. 15. In FIG. 16, reference numeral (1) indicates an output signal OUT (OUTi (Si) in FIG. 1) of the source drive circuit 3, reference numeral (2) indicates an input signal PC and reference numeral (3) indicates a signal PCB. Td indicates a 1-dot period of the liquid crystal display, and Tp indicates a precharge period.

In the conventional source drive circuit 3, as shown in FIG. 16, the precharge operation is performed for each dot and hence the precharge operation is carried out even during the precharge period Tp free of the dot inversion. However, the precharge operation at no dot inversion leads to needless power consumption.

On the other hand, as shown in FIG. 7, the source drive circuit 20 of the second embodiment performs the precharge operation in accordance with the input signal LP (polarity inversion signal) only during the precharge period Tp at the dot inversion. During the precharge period Tp free of the dot inversion, it does not perform the precharge operation and hence causes no needless power consumption. Therefore, power consumption can be reduced upon plural-dot inversion driving such as 2-dot inversion driving.

According to the second embodiment as described above, an effect similar to the first embodiment is obtained, and whether the precharge operation should be done during the precharge period (the analog switch group A should be turned ON) is controlled based on the input signal LP, whereby a needless precharge operation at the plural-dot inversion driving can be eliminated, thereby making it possible to reduce power consumption.

Incidentally, although the switch control circuits 100 and 200 are respectively constituted of the NOR gates and the inverters in the first and second embodiments, they can be realized even by other logic circuits equivalent thereto. Although the switch control circuits 100 and 200 are configured with the logic "0" as the "L" level and the logic "1" as the "H" level, they can be realized even with the logic "0" as the "H" level and the logic "1" as the "L" level.

Third Embodiment

Figure 9:
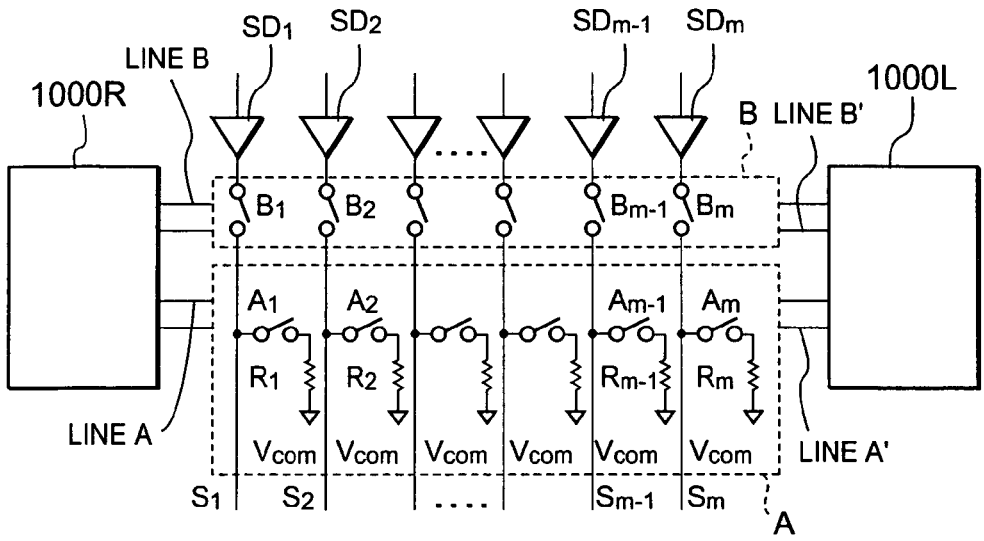
FIG. 9 is a circuit configurational diagram showing a source drive circuit of a third embodiment of the present invention.

FIG. 9 is a circuit configurational diagram showing a source drive circuit of a third embodiment of the present invention. Elements of structure similar to those shown in FIGS. 1 or 2 are respectively identified by the same reference numerals. The source drive circuit of the third embodiment includes a source driver group, an analog switch group A, an analog switch group B, and a switch control circuit 1000.

The switch control circuit 1000 shown in FIG. 9 is equivalent to the switch control circuit 100 (see FIGS. 1 and 2) of the first embodiment or the switch control circuit 200 (see FIGS. 5 and 6) of the second embodiment. The switch control circuit 1000 shown in FIG. 9 is divided into two elements so as to across the analog switch groups as described before. Therefore, in FIG. 9, a portion of the switch control circuit 1000 provided on the left side of the semiconductor chip is shown as a switch control circuit 1000L and a portion of the switch control circuit 1000 provided on the right side of the semiconductor chip is shown as a switch control circuit 1000R. As shown in FIG. 9, the source drive circuit of the third embodiment is equivalent to one wherein the configuration of the analog switch group A has been changed in the source drive circuit 10 (see FIGS. 1 and 2) of the first embodiment or the source drive circuit 20 (see FIGS. 5 and 6) of the second embodiment.

The analog switch group A of the third embodiment comprises m analog switches (MOS switches) $A_1, A_2, \ldots, A_m$, and m resistors $R_1, R_2, \ldots, R_m$. The analog switch $A_i$ and the resistor $R_i$ are provided in series between a source line $S_i$ (output terminal of source drive circuit) and a common power supply $V_{com}$ (potential at common electrode of liquid crystal cell capacitor). The analog switch A, short-circuits the source line $S_i$ (output terminal of source drive circuit) to the common power supply $V_{com}$ via the resistor $R_i$ in accordance with signals a and a' to thereby disconnect it from the common power supply $V_{com}$.

According to the third embodiment as described above, an effect similar to the first or second embodiment is obtained, and precharge is carried out via the resistors to thereby make it possible to reduce a peak current and noise at the precharge.

Fourth Embodiment

Figure 10:
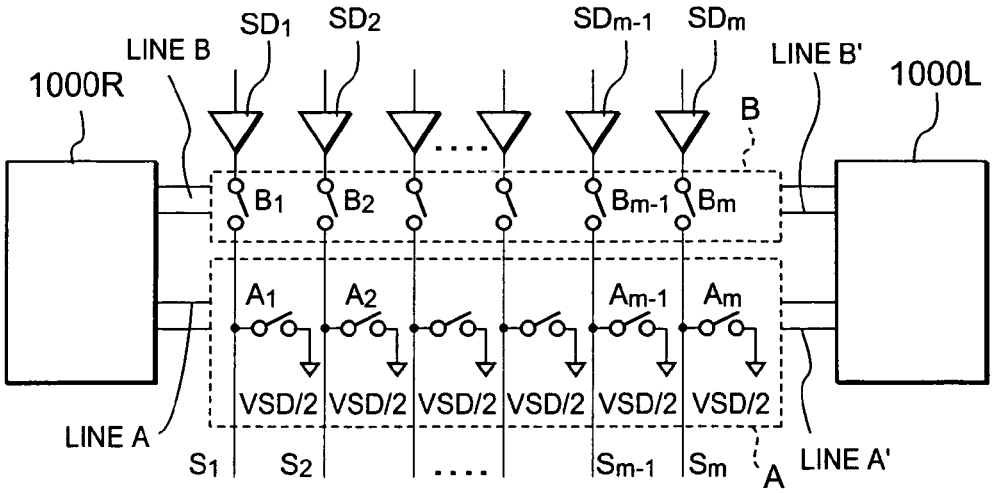
FIG. 10 is a circuit configurational diagram illustrating a source drive circuit of a fourth embodiment of the present invention.

FIG. 10 is a circuit diagram showing a source drive circuit of a fourth embodiment of the present invention. Elements of structure similar to those in FIGS. 1, 2 and 9 are respectively identified by the same reference numerals.

As shown in FIG. 10, the source drive circuit of the fourth embodiment is one wherein the configuration of the analog switch group A has been changed in the source drive circuit 10 (see FIGS. 1 and 2) of the first embodiment or the source drive circuit 20 (see FIGS. 5 and 6) of the second embodiment.

In the analog switch group A of the fourth embodiment, an analog switch $A_i$ is provided between a source line $S_i$ (output terminal of source drive circuit) and a power supply VDS/2. The analog switch $A_i$ short-circuits an output terminal $OUT_i$ (source line $S_i$) to the power supply VDS/2 in accordance with signals a and a' to thereby disconnect it from the power supply VDS/2.

Now, the power supply VDS/2 is equal to a power supply equivalent to one-half the power supply VDS supplied to source drivers $SD_1$ through $SD_m$. The power supply VDS/2 is a power supply having a potential which becomes the center of amplitude of each of the outputs of the source drivers $SD_1$ through $SD_m$.

Although the precharge power supply for short-circuiting the source line $S_i$ (output terminal of source drive circuit) for the purpose of precharge has been set as the common power supply $V_{com}$, the common power supply $V_{com}$ might be set to a potential shifted from the power supply VDS/2 to carry out elimination of flicker or the like. It is desirable that in such a case, the precharge power supply is set to the power supply VDS/2 to realize liquid crystal driving of low power consumption at high speed.

According to the fourth embodiment as described above, an effect similar to the first or second embodiment is obtained, and the precharge power supply is set to the power supply VDS/2 to thereby make it possible to realize liquid crystal driving of low power consumption at higher speed.

Fifth Embodiment

Figure 11:
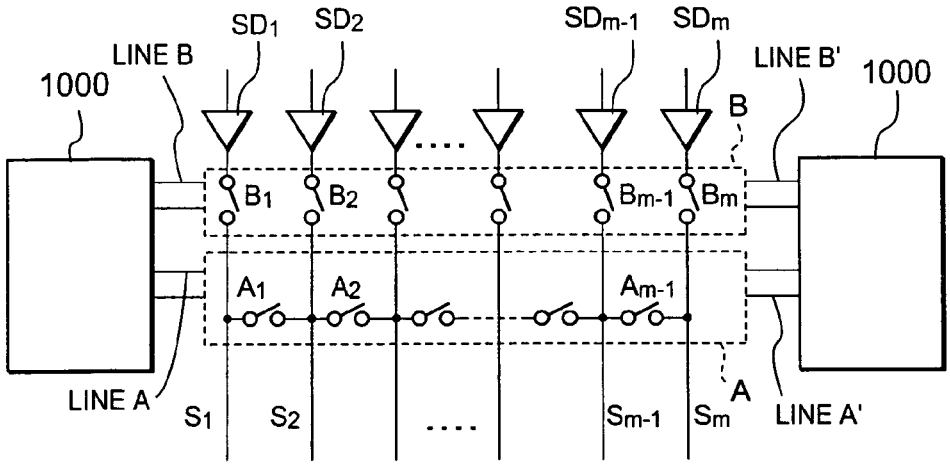
FIG. 11 is a circuit configurational diagram showing a source drive circuit of a fifth embodiment of the present invention.

FIG. 11 is a circuit diagram showing a source drive circuit of a fifth embodiment of the present invention. Elements of structure similar to those shown in FIGS. 1, 2 and 9 are respectively identified by like reference numerals.

As shown in FIG. 11, the source drive circuit of the fifth embodiment is one wherein in the source drive circuit 10 (see FIGS. 1 and 2) of the first embodiment or the source drive circuit 20 (see FIGS. 5 and 6) of the second embodiment, the analog switch group A has been changed in configuration.

The analog switch group A of the fifth embodiment comprises m−1 analog switches (MOS switches) $A_1, A_2, \ldots, A_{m-1}$. An analog switch $A_k$ (where k: any of integers from 1 to m−1) is provided between a source line $S_k$ (output terminal of source drive circuit) and a source line $S_{k+1}$ (output terminal of source drive circuit). The analog switch $A_k$ short-circuits between the source line $S_k$ (output terminal of source drive circuit) and the source line $S_{k+1}$ (output terminal of source drive circuit) and cuts off a short circuit between the source lines (output terminals of source drive circuits) in accordance with signals applied to signal lines Line A and A', respectively. Incidentally, a precharge power supply is set as other source line (other output terminal of source drive circuit) in the fifth embodiment.

According to the fifth embodiment as described above, an effect similar to the first or second embodiment is obtained, and the source lines (output terminals of source drive circuit) are short-circuited therebetween to perform precharge. Thus, since there is no need to supply the common power supply $V_{com}$ to the source drive circuit, power consumption can further be reduced.

Sixth Embodiment

Figure 12:
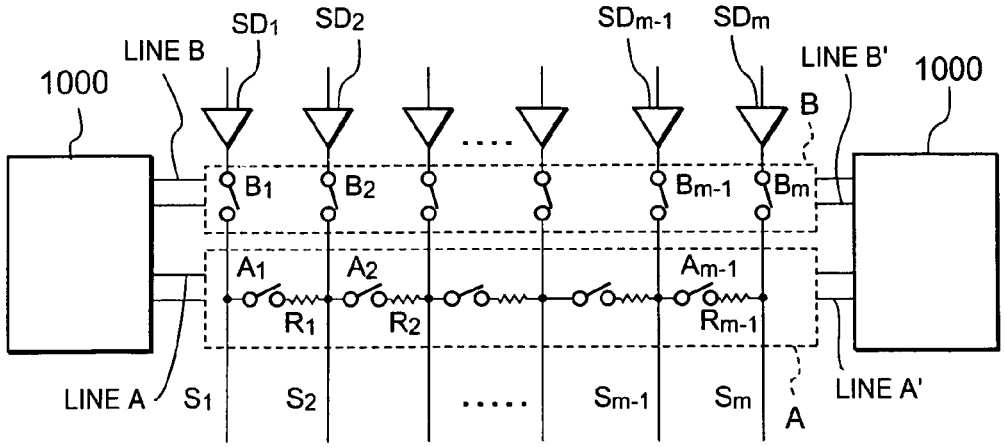
FIG. 12 is a circuit configurational diagram illustrating a source drive circuit of a sixth embodiment of the present invention.

FIG. 12 is a circuit diagram showing a source drive circuit of a sixth embodiment of the present invention. Elements of structure similar to those shown in FIG. 11 are respectively identified by the same reference numerals.

As shown in FIG. 12, the source drive circuit of the sixth embodiment is one wherein in the source drive circuit (see FIG. 11) of the fifth embodiment, the analog switch A has been changed in configuration.

The analog switch A of the sixth embodiment comprises m−1 analog switches (MOS switches) $A_1, A_2, \ldots, A_{m-1}$, and m−1 resistors $R_1, R_2, R_{m-1}$. An analog switch $A_k$ and a resistor $R_k$ are provided in series between a source line $S_k$ (output terminal of source drive circuit) and a source line $S_{k+1}$ (output terminal of source drive circuit). The analog switch $A_k$ short-circuits between the source line $S_k$ (output terminal of source drive circuit) and the source line $S_{k+1}$ (output terminal of source drive circuit) via the resistor $R_k$ and cuts off the short circuit between the source lines (output terminals of source drive circuit) in accordance with signals a and a', respectively.

According to the sixth embodiment as described above, an effect similar to the fifth embodiment is obtained, and precharge is done via the resistors to thereby make it possible to reduce a peak current and noise at the precharge.

Seventh Embodiment

Figure 13:
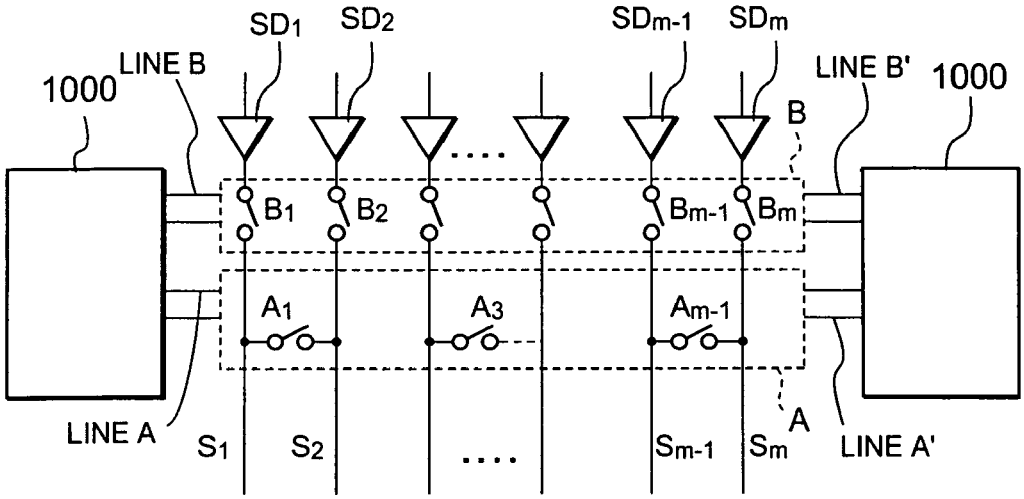
FIG. 13 is a circuit configurational diagram showing a source drive circuit of a seventh embodiment of the present invention.

FIG. 13 is a circuit diagram of a source drive circuit of a seventh embodiment of the present invention. Elements of structure similar to those shown in FIG. 11 are respectively identified by the same reference numerals.

As shown in FIG. 13, the source drive circuit of the seventh embodiment is one wherein in the source drive circuit (see FIG. 11) of the fifth embodiment, the analog switches $A_2, A_4, \ldots, A_{m-2}$ of the analog switch group A are not provided. However, m indicates an even number in the present seventh embodiment.

The analog switch group A of the seventh embodiment comprises m/2 (where m: even number in the present seventh embodiment) analog switches (MOS switches) $A_1, A_3, \ldots, A_{m-3}, A_{m-1}$. An analog switch $A_k$ is provided only between a source line $S_k$ (output terminal of source drive circuit) whose k is an odd number, and a source line $S_{k+1}$ (output terminal of source drive circuit) whose k is an odd number. No analog switch is provided between source lines $S_k$ and $S_{k+1}$ whose k is an even number. That is, the analog switch group A of the seventh embodiment is one wherein the analog switches corresponding to the number (m/2) equivalent to one-half the number (m) of the source lines are provided at the rate of one per two source lines.

According to the seventh embodiment as described above, an effect similar to the fifth embodiment is obtained, and the analog switch $A_k$ is provided only between the source lines $S_k$ (output terminal of source drive circuit) and $S_{k+1}$ (output terminal of source drive circuit) whose each k is the odd number, thereby making it possible to reduce the number of the analog switches of the analog switch group A.

Incidentally, although each of the first through seventh embodiments has explained the example in which the liquid crystal drive circuit of the present invention has been applied to the source drive circuit, the liquid crystal drive circuit of the present invention can also be applied to the gate drive circuit in like manner.

According to the present invention as described above, an effect is brought about in that overcurrent at precharge can be prevented from occurring and liquid crystal driving of low power consumption can be realized at high speed.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. A drive circuit for driving matrix lines of a matrix line group of a liquid crystal device, comprising:

a driver group having a plurality of drivers, each of which outputs a drive signal;

a first switch group having a plurality of first switches, each of which has conductive and non-conductive states, the first switch connecting an output of the driver to the matrix line in the conductive state and disconnecting the output of the driver from the matrix line in the non-conductive state;

a second switch group having a plurality of second switches, each of which has conductive and non-conductive states, the second switch connecting the matrix line to a precharge power supply in the conductive state and disconnecting the precharge power supply in the non-conductive state; and a switch control circuit which controls the conductive states of the first and second switch groups, wherein the switch control circuit sets the second switches to the conductive state when detecting all first switches of the first switch group have been made non-conductive states, and sets the first switches to the conductive state when detecting all second switches of the second switch group have been made non-conductive states.

2. A drive circuit according to claim 1, wherein the switch control circuit sets the first switches of the first switch group to the non-conductive state when an input control signal changes form a first logic value to a second logic value, wherein the switch control circuit sets the second switches of the second switch group to the conductive state when the input control signal is of the second logic value and the switch control circuit detects all the first switches of the first switch group have been made non-conductive states, wherein the switch control circuit sets the second switches of the second switch group to the non-conductive state when the input control signal changes from the second logic value to the first logic value, and wherein the switch control circuit sets the first switches of the first switch group to the conductive state when the input control signal is of the first logic value and the switch control circuit detects all the second switches of the second switch group have been made non-conductive states.

3. A drive circuit according to claim 2, wherein the first switches and the second switches comprise a plurality of analog switches respectively, wherein the switch control circuit includes, a first NOR gate which receives the input control signal as one input, a first inverter which inputs an output of the first NOR gate, a second inverter which inputs the input control signal, a second NOR gate which receives an output of the second inverter as one input, and a third inverter which inputs an output of the second NOR gate, wherein the output of the first NOR gate is connected to NMOS gates of all the analog switches of the first switch group and the input of the second NOR gate, wherein the output of the first inverter is connected to PMOS gates of all the analog switches of the first switch group, wherein the output of the second NOR gate is connected to NMOS gates of all the analog switches of the second switch group and the input of the first NOR gate, and wherein the output of the third inverter is connected to PMOS gates of all the analog switches of the second switch group.

4. A drive circuit according to claim 1, wherein the switch control circuit sets the first switches of the first switch group to the non-conductive state when a first input control signal changes from a first logic value to a second logic value, wherein when a second input control signal is of the first logic value, the switch control circuit holds the non-conductive state of the second switches even if the first input control signal is of the second logic value and the switch control circuit detects all the first switches of the first switch group have been made non-conductive states, wherein when the second input control signal is of the second logic value, the switch control circuit sets the second switches of the second switch group to the conductive state when the first input control signal is of the second logic value and the switch control circuit detects all the first switches of the first switch group have been made non-conductive states, wherein the switch control circuit sets the second switches of the second switch group to the non-conductive state when the second input control signal is of the second logic value and the first input control signal changes from the second logic value to the first logic value, and wherein the switch control circuit sets the first switches of the first switch group to the conductive state when the first input control signal is of the first logic value and the switch control circuit detects all the second switches of the second switch group have been made non-conductive states or are being held non-conductive states.

5. A drive circuit according to claim 4, wherein the first switches and the second switches comprise a plurality of analog switches respectively, wherein the switch control circuit includes, a first NOR gate which receives the first input control signal as one input, a first inverter which inputs an output of the first NOR gate, a second inverter which inputs the first input control signal, a second NOR gate which receives an output of the first inverter as one input, an AND gate which inputs the second input control signal and an output of the second NOR gate, and a third inverter which inputs an output of the AND gate, wherein the output of the first NOR gate is connected to NMOS gates of all the analog switches of the first switch group and the input of the second NOR gate, wherein the output of the first inverter is connected to PMOS gates of all the analog switches of the first switch group, wherein the output of the AND gate is connected to NMOS gates of all the analog switches of the second switch group and the input of the first NOR gate, and wherein the output of the third inverter is connected to PMOS gates of all the analog switches of the second switch group.

6. A drive circuit according to claim 1, wherein the first switch group connects the matrix line group to a common power supply of the liquid crystal device.

7. A drive circuit according to claim 1, wherein the first switch group connects the matrix line group to a power supply of a potential equivalent to one-half of a power supply supplied to the driver group.

8. A drive circuit according to claim 1, wherein the first switch group connects between two matrix lines of the matrix line group.

9. A drive circuit according to claim 8, wherein the first switch group has a configuration wherein switches corresponding to the number equivalent to one-half the number of matrix lines of the matrix line group are provided at the rate of one between the two matrix lines.

10. A drive circuit according to claim 1, wherein the first switch group connects the matrix line group via resistors.

11. A drive circuit for driving matrix lines of a matrix line group of a liquid crystal device and fanned on a semiconductor chip, comprising:

a driver group having a plurality of drivers, each of which outputs a drive signal, the driver group being formed on a central region of the semiconductor chip;

a first switch group having a plurality of first switches, each of which has conductive and non-conductive states, the first switch connecting an output of die driver to the matrix line in the conductive state and disconnecting the output of the driver from the matrix line in the non-conductive state, the first switch group being formed on the central region of the semiconductor chip;

a second switch group having a plurality of second switches, each of which has conductive and non-conductive states, the second switch connecting the matrix line to a precharge power supply in the conductive state and disconnecting the precharge power supply in the non-conductive state, the second switch group being formed on the central region of the semiconductor chip; and a switch control circuit which controls the conductive states of the first and second switch groups and formed on a peripheral region of the semiconductor chip, wherein the switch control circuit sets the second switches to the conductive state when detecting all first switches of the first switch group have been made non-conductive states, and sets the first switches to the conductive state when detecting all second switches of the second switch group have been made non-conductive states.

12. A drive circuit according to claim 11, wherein the peripheral region includes a first peripheral region provided on one side of the central region and a second peripheral region provided on the other side of the central region, wherein the switch control circuit includes a first switch control circuit portion formed on the first peripheral region and a second switch control circuit portion formed on the second peripheral region, wherein an output terminal of the first switch control circuit portion is connected to an input terminal of the second switch control circuit portion through a first wiring provided over the central region, and wherein an output terminal of the second switch control circuit portion is connected to an input terminal of the first switch control circuit portion through a second wiring provided over the central region.

13. A drive circuit according to claim 12, wherein the length of the first wiring is equal to the length of the second wiring.

14. A drive circuit according to claim 12, wherein the resistance value of the first wiring is equal to the resistance value of the second wiring.

15. A drive circuit according to claim 11, wherein the switch control circuit comprises a flip-flop circuit.

* * * * *